US007344213B2

(12) United States Patent
Iwamoto et al.

(10) Patent No.: US 7,344,213 B2
(45) Date of Patent: Mar. 18, 2008

(54) METHOD AND SYSTEM FOR CALCULATING INK RESIDUE AND INK CONTAINER

(75) Inventors: Manabu Iwamoto, Ami-machi (JP); Kenji Oshima, Ami-machi (JP); Masakatsu Arai, Ami-machi (JP)

(73) Assignee: Riso Kagaku Corporation, Shiba, Minato-Ku, Tokyo (JP)

( * ) Notice: Subject to any disclaimer, the term of this patent is extended or adjusted under 35 U.S.C. 154(b) by 67 days.

(21) Appl. No.: 10/543,052

(22) PCT Filed: Dec. 4, 2003

(86) PCT No.: PCT/JP03/15549

§ 371 (c)(1),
(2), (4) Date: Sep. 28, 2005

(87) PCT Pub. No.: WO2004/065125

PCT Pub. Date: Aug. 5, 2004

(65) Prior Publication Data

US 2006/0109289 A1 May 25, 2006

(30) Foreign Application Priority Data

Jan. 21, 2003 (JP) ..... 2003-011818

(51) Int. Cl.
*B41J 29/38* (2006.01)

(52) U.S. Cl. ..... 347/6; 347/7; 347/14

(58) Field of Classification Search ..... 347/6, 347/7, 14

See application file for complete search history.

(56) References Cited

U.S. PATENT DOCUMENTS

| | | | | |
|---|---|---|---|---|
| 4,575,735 A * | 3/1986 | Weinberg | ..... | 347/7 |
| 5,699,731 A | 12/1997 | Hara | | |
| 6,517,175 B2 * | 2/2003 | Kanaya et al. | ..... | 347/7 |
| 6,530,519 B1 | 3/2003 | Suzuki | | |

FOREIGN PATENT DOCUMENTS

| | | |
|---|---|---|
| JP | 2-148360 | 12/1990 |
| JP | 3-184889 | 8/1991 |
| JP | 10-133529 | 5/1998 |
| JP | 2001-18507 | 1/2001 |
| JP | 2002-86678 | 3/2002 |
| JP | 2003-72033 | 3/2003 |

* cited by examiner

*Primary Examiner*—Thinh Nguyen
(74) *Attorney, Agent, or Firm*—Matthew K. Ryan; Frommer Lawrence and Haug

(57) ABSTRACT

The Abstract as it appears in the enclosed English language translation is the more accurate and faithful translation of the original Abstract as it was filed in the PCT International application, and it is therefore requested that the Abstract be changed to this Abstract that more accurately identifies this invention, and as it has been faithfully re-translated by our Japanese associate and translator.

10 Claims, 3 Drawing Sheets

FIG.4

| | PARAMETER | | |
|---|---|---|---|
| WORKING ENVIRONMENTAL TEMPERATURE (℃) | 1 | 2 | 3 |
| -20~0℃ | 5[ml/s] | 8[ml/s] | 10[ml/s] |
| 0~20℃ | 12[ml/s] | 13[ml/s] | 15[ml/s] |
| 20~40℃ | 15[ml/s] | 17[ml/s] | 18[ml/s] |
| 40~60℃ | 20[ml/s] | 22[ml/s] | 24[ml/s] |

METHOD AND SYSTEM FOR CALCULATING INK RESIDUE AND INK CONTAINER

FIELD OF THE INVENTION

This invention relates to an ink residue calculating system which calculates an ink residue in an ink container.

BACKGROUND OF THE INVENTION

There have been variously proposed stencil printers where print is made by driving, for instance, a thermal head according to image data obtained by reading out an original by, for instance, a scanner to selectively melt and perforate stencil material to make a stencil, winding the stencil around a printing drum, supplying ink inside the printing drum, and transferring the ink to printing papers through the stencil by, for instance, a roller.

In the stencil printers described above, a removable ink container is employed for the reason of easiness in handling or the like. When the ink in an ink container is consumed, the ink container is removed from the stencil printer and a new ink container filled with ink is mounted on the stencil printer.

The ink container comprises, for instance, an ink cylinder provided with an ink discharge port on its leading end and an ink piston slidable along the inner surface of the side wall of the ink cylinder, and the ink is accommodated in the space surrounded by the ink cylinder and the ink piston. In the ink container, as the ink is sucked through the ink discharge port by the ink supply pump, the ink piston is pushed toward the ink discharge port under the atmospheric pressure.

When such an ink container is used, the ink can be accidentally exhausted to deteriorate the workability unless the ink residue is known. Though the ink residue can be visually known, since the ink container is generally installed inside the printer which cannot be viewed from the outside, the printing action must be interrupted to visually know the ink residue, which can also deteriorate the workability. Further, direct measurement of the ink residue in the ink container or the ink consumption adds to the overall size of the printer and at the same time makes it difficult to measure it at high accuracy.

In Japanese Unexamined Patent Publication No. 2002-86678, there has been proposed a method of calculating the ink residue where the difference in light-transmittance between the part where ink adhering to the inner wall of the ink cylinder is scraped off the inner wall of the ink cylinder in response to slide of the ink piston and the part which does not undergo such slide of the ink piston is utilized to calculate the ink residue, and in Japanese Unexamined Patent Publication No. 10(1998)-133529, there has been proposed a method of calculating the ink residue where the position of the ink piston is detected by detecting a metal piece mounted on a side surface of the ink piston by sensors provided along a side surface and the ink residue is calculated on the basis of the position of the ink piston. However, the method disclosed in Japanese Unexamined Patent Publication No. 2002-86678 gives rise to a problem that since adhesion of the ink to the inner wall of the ink cylinder fluctuates, the part where ink adhering to the inner wall of the ink cylinder is scraped off the inner wall of the ink cylinder in response to slide of the ink piston and the part which does not undergo such slide of the ink piston can be mistaken for each other. Further, the method disclosed in Japanese Unexamined Patent Publication No. 10(1998)-133529 gives rise to a problem that since a metal piece is mounted on the ink piston in the ink container, the cost increases and at the same time, it becomes difficult to recycle the ink container after use. Further, since the number of light emitting elements and light receiving elements is limited, accurate calculation of the ink residue at a fine unit is difficult and leads to increase in the cost.

Accordingly, in Japanese Unexamined Patent Publication No. 2001-18507, there has been proposed a method of calculating the ink residue where the working time of the ink supply pump or the number of rotations of the ink supply pump drive motor is measured, the ink discharge from the ink container is calculated on the basis of, for instance, the working time of the ink supply pump and the ink residue is calculated by cumulatively subtracting the ink discharge from the total ink volume accommodated in the ink container.

However, the method disclosed in Japanese Unexamined Patent Publication No. 2001-18507 is disadvantageous in that, for instance, when the ink residue is calculated on the basis of the working time of the ink supply pump, since viscosity of ink changes depending on the kind or the working environmental temperature of the ink and load of the ink on the ink supply motor changes with change in viscosity of the ink, which changes the rotational speed of the drive motor of the ink supply pump, the ink discharge from the ink container for a given working time of the ink supply pump changes depending on the kind or the working environmental temperature of the ink, whereby the ink residue cannot be accurately calculated.

Further, for instance, when ink of low viscosity is accommodated in an ink container, an ink container having a small discharge port can be used since there is a fear that the ink can flow out through the ink discharge port. When the size of the ink discharge port differs depending on the kind of ink, the ink discharge for a unit rotation of the ink supply pump or the drive motor of the ink supply pump differs depending on the kind of ink and accordingly, the ink residue cannot be accurately calculated on the basis of the number of rotation of the drive motor of the ink supply pump.

In view of the foregoing observations and description, the primary object of the present invention is to provide a method of, a system for and an ink container which permit accurate calculation of the ink residue where the ink residue is calculated on the basis of the working time of the ink supply pump or the number of rotations of the ink supply pump drive motor even if the kind of ink and/or the working environmental temperature of the ink changes.

SUMMARY OF THE INVENTION

In accordance with the present invention, there is provided a first ink residue calculating method comprising, in a method where the ink residue is calculated by obtaining ink discharge discharged from an ink container on the basis of the working time of an ink supply pump which sucks ink from the ink container and discharges the same and the ink discharge per unit working time of the ink supply pump or on the basis of the number of rotations of a drive motor of the ink supply pump and the ink discharge of the ink supply pump per unit rotation of the drive motor and cumulatively subtracting the ink discharge discharged from the ink container from the total ink volume accommodated in the ink container, the steps of obtaining the kind of the ink, correcting the ink discharge per unit working time of the ink supply pump or the ink discharge of the ink supply pump per unit rotation of the drive motor on the basis of the obtained kind of the ink, and calculating the ink residue on the basis of the corrected ink discharge.

In order "to obtain the kind of the ink", the kind of the ink may be obtained either by the operator of the system directly inputting the kind of the ink through a predetermined input means or by reading out the kind of the ink from a memory provided on the ink container.

The "kind of the ink" may be information itself on the kind of the ink or a predetermined parameter representing the kind of the ink or a viscosity of the ink or a parameter representing the viscosity of the ink, and may be any so long as it is data representing information on the kind of the ink.

Further, in order for "correcting the ink discharge per unit working time of the ink supply pump or the ink discharge of the ink supply pump per unit rotation of the drive motor on the basis of the obtained kind of the ink, and calculating the ink residue on the basis of the corrected ink discharge", the value obtained by multiplying corrected ink discharge, which is obtained by multiplying the ink discharge per unit working time of the ink supply pump or the ink discharge of the ink supply pump per unit rotation of the drive motor for standard ink by a predetermined correction factor according to the kind of the ink, by the working time of the ink supply pump or the number of rotation of the drive motor may be cumulatively subtracted from the total ink volume accommodated in the ink container, or a standard discharge value is first obtained by multiplying the ink discharge per unit working time of the ink supply pump or the ink discharge of the ink supply pump per unit rotation of the drive motor for the standard ink by the working time of the ink supply pump or the number of rotation of the drive motor and then the value obtained by multiplying the standard discharge value by a predetermined correction factor according to the kind of the ink may be cumulatively subtracted from the total ink volume accommodated in the ink container. Further, the ink residue may be calculated by, for instance, empirically obtaining in advance the ink discharge per unit working time of the ink supply pump or the ink discharge of the ink supply pump per unit rotation of the drive motor for each of the kinds of the ink, and taking the obtained ink discharge as the corrected ink discharge and cumulatively subtracting the value obtained by multiplying the corrected ink discharge by the working time of the ink supply pump or the number of rotation of the drive motor from the total ink volume accommodated in the ink container. Further, the ink residue may be calculated by first cumulatively subtracting from the total ink volume accommodated in the ink container the value obtained by multiplying the ink discharge per unit working time of the ink supply pump or the ink discharge of the ink supply pump per unit rotation of the drive motor for standard ink by the working time of the ink supply pump or the number of rotation of the drive motor and then multiplying the remainder by a predetermined proportion on the basis of the ratio between the ink discharge per unit working time of the ink supply pump or the ink discharge of the ink supply pump per unit rotation of the drive motor obtained in advance for the standard ink and the corrected ink discharge. That is, the ink residue may be calculated in any manner so long as the ink discharge per unit working time of the ink supply pump or the ink discharge of the ink supply pump per unit rotation of the drive motor is corrected and the ink residue is calculated on the basis of the corrected ink discharge.

In accordance with the present invention, there is further provided a second ink residue calculating method comprising, in a method where the ink residue is calculated by obtaining ink discharge discharged from an ink container on the basis of the working time of an ink supply pump which sucks ink from the ink container and discharges the same and the ink discharge per unit working time of the ink supply pump and cumulatively subtracting the ink discharge discharged from the ink container from the total ink volume accommodated in the ink container, the steps of obtaining the working environmental temperature of the ink, correcting the ink discharge per unit working time of the ink supply pump on the basis of the obtained working environmental temperature of the ink, and calculating the ink residue on the basis of the corrected ink discharge.

Further, in order for "correcting the ink discharge per unit working time of the ink supply pump on the basis of the obtained working environmental temperature of the ink, and calculating the ink residue on the basis of the corrected ink discharge", the value obtained by multiplying corrected ink discharge, which is obtained by multiplying the ink discharge per unit working time of the ink supply pump which is obtained in advance for a normal temperature by a predetermined correction factor according to the working environmental temperature of the ink, by the working time of the ink supply pump may be cumulatively subtracted from the total ink volume accommodated in the ink container. Other methods may be the same as those described above in conjunction with the calculation of the ink residue on the basis of the kind of the ink.

Further, in the second ink residue calculating method, the kind of the ink may be obtained, the ink discharge per unit working time may be corrected on the basis of the obtained kind of the ink and the working environmental temperature, and the ink residue may be calculated on the basis of the corrected ink discharge.

In accordance with the present invention, there is further provided a first ink residue calculating system comprising, in a system where the ink residue is calculated by obtaining ink discharge discharged from an ink container on the basis of the working time of an ink supply pump which sucks ink from the ink container and discharges the same and the ink discharge per unit working time of the ink supply pump or on the basis of the number of rotations of a drive motor of the ink supply pump and the ink discharge of the ink supply pump per unit rotation of the drive motor and cumulatively subtracting the ink discharge discharged from the ink container from the total ink volume accommodated in the ink container, an ink kind obtaining means which obtains the kind of the ink, and an ink residue calculating means which corrects the ink discharge per unit working time of the ink supply pump or the ink discharge of the ink supply pump per unit rotation of the drive motor on the basis of the kind of the ink obtained by the ink kind obtaining means, and calculates the ink residue on the basis of the corrected ink discharge.

In accordance with the present invention, there is further provided a second ink residue calculating system comprising, in a system where the ink residue is calculated by obtaining ink discharge discharged from an ink container on the basis of the working time of an ink supply pump which sucks ink from the ink container and discharges the same and the ink discharge per unit working time of the ink supply pump and cumulatively subtracting the ink discharge discharged from the ink container from the total ink volume accommodated in the ink container, a temperature detecting means which detects the working environmental temperature of the ink, and an ink residue calculating means which corrects the ink discharge per unit working time of the ink supply pump on the basis of the working environmental temperature of the ink obtained by the temperature detecting means, and calculates the ink residue on the basis of the corrected ink discharge.

Further, the second ink residue calculating system may further comprises an ink kind obtaining means which obtains the kind of the ink, wherein the ink residue calculating means corrects the ink discharge per unit working time on the basis of the kind of the ink obtained by the ink kind obtaining means and the working environmental temperature, and calculates the ink residue on the basis of the corrected ink discharge.

In accordance with the present invention, there is further provided a first ink container which is used for carrying out the first or second ink residue calculating method and comprises a storage means which stores kind data according to the kind of the ink.

As the storage means which stores kind data according to the kind of the ink may be any so long as it can store information on the kind of the ink. For example, the storage means may be a memory for storing data on the kind of the ink or information on the kind of the ink such as a bar code.

In accordance with the present invention, there is further provided a second ink container which is used for carrying out the first ink residue calculating method and comprises a storage means which stores a parameter used in the correction based on the kind of the ink.

The parameter may be, for instance, the above-mentioned correction factor, but may be the corrected ink discharge itself.

In accordance with the present invention, there is further provided a third ink container which is used for carrying out the second ink residue calculating method and comprises a storage means which stores a parameter used in the correction based on the working environmental temperature of the ink.

In accordance with the present invention, there is further provided a fourth ink container which is used for carrying out the second ink residue calculating method and comprises a storage means which stores a parameter used in the correction based on the kind of the ink and the working environmental temperature of the ink.

In accordance with the first ink residue calculating method and system of the present invention, the kind of the ink is obtained, the ink discharge per unit working time of the ink supply pump or the ink discharge of the ink supply pump per unit rotation of the drive motor is corrected on the basis of the obtained kind of the ink, and the ink residue is calculated on the basis of the corrected ink discharge. Accordingly, the residue of ink in each ink container can be accurately calculated even if ink containers containing therein different kinds of ink are used.

In accordance with the second ink residue calculating method and system of the present invention, the working environmental temperature of the ink is obtained, the ink discharge per unit working time of the ink supply pump is corrected on the basis of the obtained working environmental temperature of the ink, and the ink residue is calculated on the basis of the corrected ink discharge. Accordingly, the residue of ink in an ink container can be accurately calculated even if the viscosity of the ink changes with change in the working environmental temperature of the ink.

Further, in the second ink residue calculating method, when the kind of the ink is obtained, the ink discharge per unit working time is corrected on the basis of the obtained kind of the ink and the working environmental temperature, and the ink residue is calculated on the basis of the corrected ink discharge, the residue of ink in an ink container can be accurately calculated even if the kind of the ink changes as well as the working environmental temperature of the ink changes.

Since the first ink container of the present invention comprises a storage means which stores kind data according to the kind of the ink, the kind of the ink can be automatically obtained by reading out the kind data from the storage means.

Since the second ink container of the present invention comprises a storage means which stores a parameter used in the correction based on the kind of the ink, the correction based on the kind of the ink can be made on the basis of the parameter even if the kind of the ink has not been set in advance in a system in which the ink container is installed.

Since the third ink container of the present invention comprises a storage means which stores a parameter used in the correction based on the working environmental temperature of the ink, it is not necessary to store in advance a parameter used in the correction based on the working environmental temperature of the ink in the system in which the ink container is installed, whereby consumption of the area of the memory of the system can be saved.

Since the fourth ink container of the present invention comprises a storage means which stores a parameter used in the correction based on the kind of the ink and the working environmental temperature of the ink, the correction based on the kind of the ink and the working environmental temperature of the ink can be made on the basis of the parameter even if the kind of the ink has not been set in advance in a system in which the ink container is installed.

BRIEF DESCRIPTION OF THE DRAWINGS

FIG. 4 is a temperature-dependency correction table set in the ink residue calculating means in the stencil printer shown in FIG. 1.

PREFERRED EMBODIMENTS OF THE INVENTION

Figure 1:
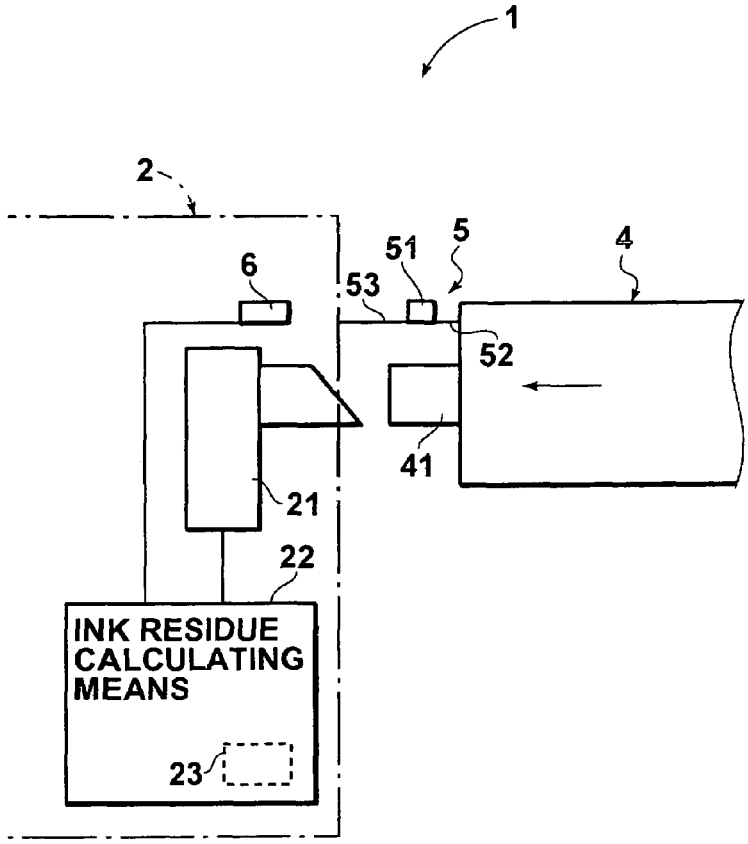
FIG. 1 is a view showing in brief a stencil printer employing an ink residue calculating system in accordance with an embodiment of the present invention.

A stencil printer using an ink residue calculating system and an ink container for carrying out an ink residue calculating method in accordance with an embodiment of the present invention will be described, hereinbelow, with reference to the drawings. FIG. 1 is a view showing a part of the stencil printer, and FIG. 2 is a schematic perspective view showing installation of the ink container in the stencil printer.

Figure 2:
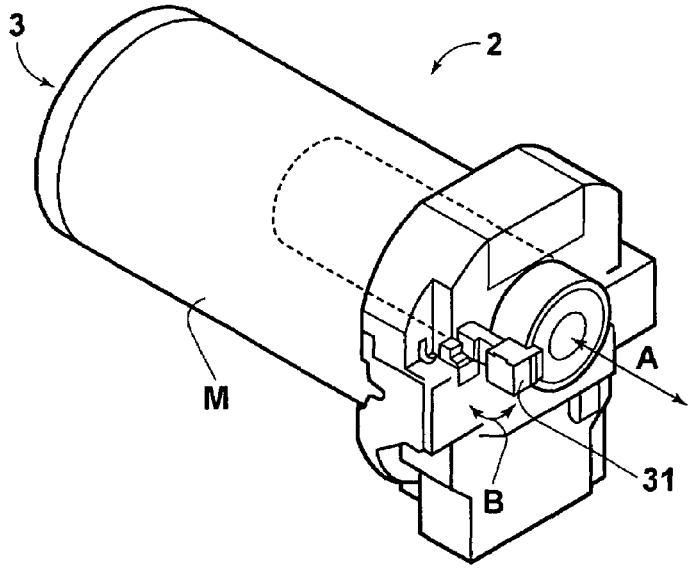
FIG. 2 is a schematic perspective view showing installation of the ink container in the stencil printer shown in FIG. 1.

The stencil printer 1 comprises a printing drum 3 provided in a system body 2 as shown in FIG. 2. A stencil M is wound around the outer peripheral surface of the printing drum 3, and an ink container 4 filled with ink is installed inside the printing drum 3. The ink container 4 is moved back and forth in and out the printing drum 3 in the direction of arrow A from the center of one end face thereof and is changeable by moving the locking member 31 in the direction of arrow B. The ink container is provided at its leading end with an opening 41 through which the ink is discharged. The opening 41 is connected to an ink supply pump 21 (FIG. 1) and the ink in the ink container 4 is sucked by the ink supply pump 21 to be discharged from the ink container 4 and used for printing. As the printing progresses, the ink in the ink container 4 is supplied and consumed, and when the ink in the ink container 4 is exhausted, the ink container 4 is demounted and a new ink container 4 is mounted.

A storage means 5 which stores a correction factor which has been set in advance according to the kind of the ink in the ink container 4 and the total amount of ink filled in the ink container 4 before use is disposed on the leading end portion of the ink container 4. The storage means 5 comprises a memory IC 51 forming a non-volatile memory (e.g., an EEPROM) which can hold data for a predetermined time without power supply, and a contact 53 is provided on the tip of a board 52 on which the memory IC 51 is mounted. The correction factor will be described later.

A connector 6 which is to be electrically connected to the contact 53 of the storage means 5 of the ink container is provided near the ink supply pump 21.

Figure 3:
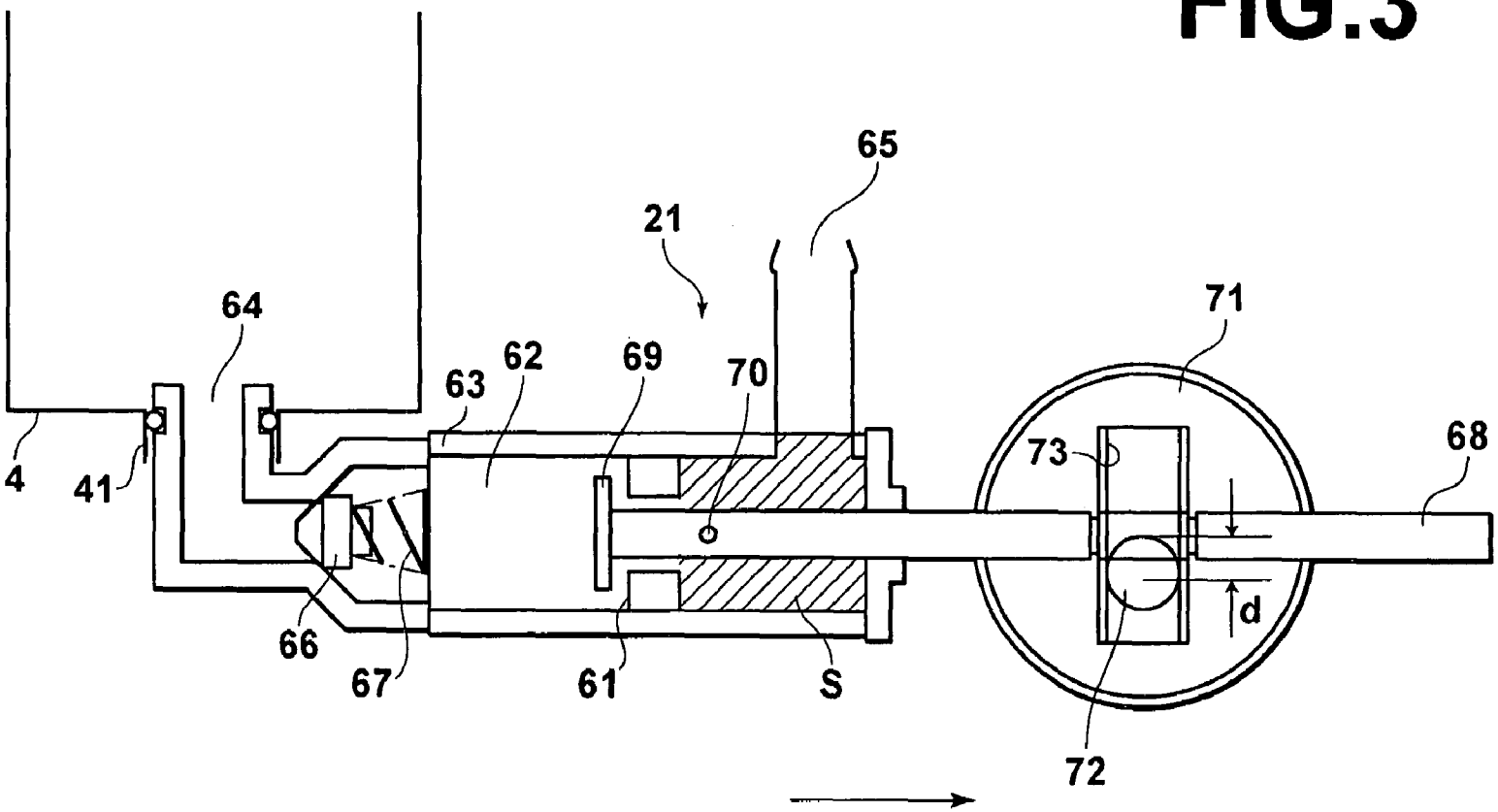
FIG. 3 is a vertical cross-sectional view of the ink supply pump in the stencil printer shown in FIG. 1.

The ink supply pump 21 is a piston pump such as shown in FIG. 3. FIG. 3 is a vertical cross-sectional view of the ink supply pump 21. The ink supply pump 21 comprises, as shown in FIG. 3, a piston 61, a pump chamber 62 in which the piston 61 is moved back and forth, a cylinder 63 in which the piston slides, an ink sucking port 64 on which the opening 41 of the ink container 4 is mounted, and an ink discharge port 65 through which the ink is supplied to the inside of the printing drum 3, and a sucking-side pump valve 66 which is urged to close the ink passage by a coiled spring 67 and functions as a check valve which only permits the ink to flow into the pump chamber 62 from the ink container 4 is provided on one end of the cylinder 63. Whereas, a piston valve 69 is provided on one end of a rod shaft 68, a pin 70 for pushing the piston 61 in the direction reverse to the direction of the arrow is provided on the rod shaft 68 in a predetermined position, and a mechanism for reciprocating the piston 61 is provided on the other and of the rod shaft 68 outside the cylinder 63. The mechanism for reciprocating the piston 61 comprises a gear 71 which is rotated by a drive motor not shown, an eccentric cam 72 which is fixed to the gear 71 off-centered from the rotational center of the gear 71 by a predetermined distance d, and a groove 73 which is engaged with the eccentric cam 72.

In the ink supply pump 21, the rod shaft 68 is reciprocated by way of the eccentric cam 72 in response to rotation of the gear 71, and the piston 61 between the piston valve 69 on the end of the rod shaft 68 and the pin 70 slides in the cylinder 63. When the rod shaft 68 is pulled in the direction of the arrow, the piston valve 69 and the piston 61 are brought into contact with each other, whereby the pump chamber 62 is closed. Whereas, when the piston 61 is pulled in the direction of the arrow, the pump valve 66 is opened and the ink is sucked from the ink container 4, whereby the pump chamber 62 is filled with the ink. When the rod shaft 68 is pushed in the direction reverse to the direction of the arrow, the pin 70 and the piston 61 are brought into contact with each other and the piston 61 is pushed in the direction reverse to the direction of the arrow, and the pump valve 66 is closed and the piston valve 69 is opened, whereby the ink in the pump chamber 62 flows into the hatched portion S. When the piston 61 is further pulled in the direction of the arrow, the ink in the hatched portion S is discharged through the ink discharge port 65, and the discharged ink is supplied in the printing drum 3. When the amount of ink in the printing drum 3 reaches a predetermined amount, the rotation of the gear 71 is stopped and the supply of ink is stopped.

The stencil printer 1 comprises, as shown in FIG. 1, an ink residue calculating means 22 having an encoder which counts the number of rotation of the drive motor of the ink supply pump 21. The ink residue calculating means 22 obtains a corrected ink discharge by multiplying the ink discharge per unit number of rotation for standard ink by a correction factor read out from the storage means 5 of the ink container 4, multiplies the corrected ink discharge by the number of rotations counted by the encoder to obtain an ink discharge discharged from the ink container and calculates the ink residue by cumulatively subtracting the ink discharge discharged from the ink container from the total ink volume accommodated in the ink container. The correction factor has been obtained in the following manner. Using standard ink, the ink discharge discharged from the ink container 4 is first checked when the number of pulses counted by the encoder reaches 100. Assuming that the ink discharge is, for instance, 5 ml, this value is stored by the ink residue calculating means 22. The ink residue calculating means 22 calculates the ink consumption on the basis of the number of pulses counted by the encoder and this value. However, if the ink to be used is lower than the standard ink in viscosity, the size of the opening 41 of the ink container 4 is reduced since the ink is more likely to leak through the opening 41. In this case, the ink discharge discharged from the ink container 4 when the number of pulses counted by the encoder reaches 100 is smaller than 5 ml and, the ink consumption calculated by the ink residue calculating means 22 is larger than the actual ink discharge discharged from the ink container 4. Accordingly, a correction factor smaller than 100% is stored in the storage means 5 of an ink container 4 in which ink lower than the standard ink in viscosity is filled. That is, when the ink discharge discharged from the ink container 4 when the number of pulses counted by the encoder reaches 100 is a half of 5 ml, then the correction factor may be 50%. Conversely, when the ink to be used is higher than the standard ink in viscosity, a correction factor larger than 100% is stored in the storage means 5 of the ink container 4.

Calculation of the ink residue in the stencil printer 1 will be described, hereinbelow.

First the ink container 4 is connected to the ink supply pump 21. With this, the contact 53 of the storage means 5 of the ink container 4 is electrically connected to the connector 6 provided in the vicinity of the ink supply pump 21 and the correction factor and the total ink volume stored in the storage means 5 are read out by the ink residue calculating means 22 to be stored in a memory 23 provided in the ink residue calculating means 22.

The ink is sucked from the ink container 4 and discharged inside the printing drum 3 in response to action of the ink supply pump 21. An ink sensor (not shown) is disposed in the printing drum 3 and the ink is discharged until the ink is brought into contact with the ink sensor. The ink supply pump 21 is operated in the manner described above, and at the same time, the number of rotations of the drive motor of the ink supply motor 21 is counted as a number of the pulses by the encoder of the ink residue calculating means 22. The ink residue calculating means 22 calculates the corrected ink discharge by multiplying the ink discharge per 100 pulses for the standard ink which has been set in advance by the correction factor read out from the memory 24, and calculates the ink discharge discharged from the ink container 4 by multiplying the corrected ink discharge by the value obtained by dividing the counted number of pulses by 100. Then the ink residue calculating means 22 calculates the ink residue by subtracting the ink discharge discharged from the ink container 4 from the total ink volume read out from the memory 24 and stores the ink residue in the memory 24. The ink residue stored in the memory 24 is stored in the storage means 5 by way of the connector 6 and the contact 53.

When the stencil M made by the stencil printer 1 is wound around the printing drum 3 and the printing has been made, whereby the ink in the printing drum 3 is consumed so that no ink is detected by the ink sensor, the ink supply pump 21 is operated again and the ink in the ink container 4 is discharged inside the printing drum 3. On the other hand, the ink residue calculating means 22 reads out the ink residue and the correction factor stored in the storage means 5, and calculates the ink discharge in the same manner as described above. Then the ink residue calculating means 22 calculates the new ink residue by subtracting the ink discharge discharged from the ink container 4 from the ink residue read out from the storage means 5 and stores the new ink residue in the storage means 5 as well as in the memory 24.

In the stencil printer, the kind of the ink is obtained, the ink discharge for the unit rotation is corrected on the basis of the obtained kind of the ink, and the ink residue is calculated on the basis of the corrected ink discharge. Accordingly, the residue of ink in each ink container can be accurately calculated even if ink containers containing therein different kinds of ink are used.

Though, in the embodiment described above, the correction factor is stored in the storage means 5 of the ink container 4, it is possible to store only data on the kind of ink in the storage means 5 and to store a table where the kind of ink is related to the correction factor in the ink residue calculating means 22 so that the ink residue calculating means 22 reads out the data on the kind of ink from the storage means 5 and obtains the correction factor with reference to the table.

Though, in the embodiment described above, the ink discharge discharged from the ink container 4 is calculated on the basis of the number of rotations of the drive motor of the ink supply pump 21 by the ink residue calculating means 22, it is possible to provide the ink residue calculating means 22 with a timer to measure the working time of the ink supply pump 21 and to calculate the ink discharge discharged from the ink container 4 on the basis of the working time of the ink supply pump 21. For example, the ink discharge per unit working time of the ink supply pump for standard ink is first stored, the ink discharge per unit working time is multiplied by the correction factor to calculate the corrected ink discharge and the ink discharge discharged from the ink container 4 is calculated by multiplying the corrected ink discharge by the working time measured by the timer.

When the ink discharge discharged from the ink container 4 is calculated on the basis of the working time of the ink supply pump 21, the viscosity of the ink changes with the working environmental temperature of the ink, which changes the load on the ink supply pump 21 and changes the ink discharge discharged from the ink container 4 for a given working time of the ink supply pump 21. Accordingly, it is possible to provide a temperature detecting means such as a temperature sensor and to provide the ink residue calculating means 22 with a temperature-dependency correction table such as shown in FIG. 4 so that the ink residue calculating means 22 calculates the corrected ink discharge by referring to the temperature-dependency correction table according to the temperature detected by the temperature detecting means, the ink discharge discharged from the ink container 4 is calculated by multiplying the corrected ink discharge by the working time, and calculates the ink residue by subtracting the ink discharge discharged from the ink container 4 from the total ink volume. The FIGS. 1, 2, and 3 in FIG. 4 respectively show the parameters representing the kinds of ink. Each of the parameters is stored in the storage means 5 of the ink container 4 and read out when the corrected ink discharge is obtained by referring to the temperature-dependency correction table. The corrected ink discharge is obtained on the basis of the parameter and the working environmental temperature.

Further, it is possible to store in the storage means 5 of the ink container 4 a temperature-dependency correction table where the working environmental temperature is related to the corrected ink discharge so that the ink residue calculating means 22 reads out the corrected ink discharge according to the working environmental temperature from the temperature-dependency correction table stored in the storage means 5 and obtains the correction factor with reference to the table. In this case, a temperature-dependency correction table suitable for the kind of the ink in the ink container 4 is stored in the storage means 5 of the ink container 4.

The invention claimed is:

1. An ink residue calculating system comprising, in a system where the ink residue is calculated by obtaining ink discharge discharged from an ink container on the basis of the working time of an ink supply pump which sucks ink from the ink container and discharges the same and the ink discharge per unit working time of the ink supply pump or on the basis of the number of rotations of a drive motor of the ink supply pump and the ink discharge of the ink supply pump per unit rotation of the drive motor and cumulatively subtracting the ink discharge discharged from the ink container from the total ink volume accommodated in the ink container, an ink kind obtaining means which obtains the kind of the ink, and an ink residue calculating means which corrects the ink discharge per unit working time of the ink supply pump or the ink discharge of the ink supply pump per unit rotation of the drive motor on the basis of the kind of the ink obtained by the ink kind obtaining means, and calculates the ink residue on the basis of the corrected ink discharge.

2. An ink residue calculating system as defined in claim 1 in which the kind of the ink represents the viscosity of the ink.

3. An ink residue calculating system comprising, in a system where the ink residue is calculated by obtaining ink discharge discharged from an ink container on the basis of the working time of an ink supply pump which sucks ink from the ink container and discharges the same and the ink discharge per unit working time of the ink supply pump and cumulatively subtracting the ink discharge discharged from the ink container from the total ink volume accommodated in the ink container, a temperature detecting means which detects the working environmental temperature of the ink, and an ink residue calculating means which corrects the ink discharge per unit working time of the ink supply pump on the basis of the working environmental temperature of the ink obtained by the temperature detecting means, and calculates the ink residue on the basis of the corrected ink discharge; and an ink kind obtaining means which obtains the kind of the ink, wherein the ink residue calculating means corrects the ink discharge per unit working time on the basis of the kind of the ink obtained by the ink kind obtaining means and the working environmental temperature, and calculates the ink residue on the basis of the corrected ink discharge.

4. An ink residue calculating system as defined in claim 3 in which the kind of the ink represents the viscosity of the ink.

5. An ink residue calculating system comprising, in a system where the ink residue is calculated by obtaining ink discharge discharged from an ink container on the basis of the working time of an ink supply pump which sucks ink from the ink container and discharges the same and the ink discharge per unit working time of the ink supply pump or on the basis of the number of rotations of a drive motor of the ink supply pump and the ink discharge of the ink supply pump per unit rotation of the drive motor and cumulatively subtracting the ink discharge discharged from the ink container from the total ink volume accommodated in the ink container, an ink container which is provided with a storage means which stores kind data according to the kind of the ink, an ink kind obtaining means which obtains the kind data, and an ink residue calculating means which corrects the ink discharge per unit working time of the ink supply pump or the ink discharge of the ink supply pump per unit rotation of the drive motor on the basis of the kind data obtained by the ink kind obtaining means, and calculates the ink residue on the basis of the corrected ink discharge.

6. An ink residue calculating system as defined in claim 5 in which the kind of the ink represents the viscosity of the ink.

7. An ink residue calculating system comprising, in a system where the ink residue is calculated by obtaining ink discharge discharged from an ink container on the basis of the working time of an ink supply pump which sucks ink from the ink container and discharges the same and the ink discharge per unit working time of the ink supply pump or on the basis of the number of rotations of a drive motor of the ink supply pump and the ink discharge of the ink supply pump per unit rotation of the drive motor and cumulatively subtracting the ink discharge discharged from the ink container from the total ink volume accommodated in the ink container, an ink container which is provided with a storage means which stores a parameter used in the correction based on the kind of the ink, an ink kind obtaining means which obtains the parameter, and an ink residue calculating means which corrects the ink discharge per unit working time of the ink supply pump or the ink discharge of the ink supply pump per unit rotation of the drive motor on the basis of the parameter obtained by the ink kind obtaining means, and calculates the ink residue on the basis of the corrected ink discharge.

8. An ink residue calculating system as defined in claim 7 in which the kind of the ink represents the viscosity of the ink.

9. An ink residue calculating system comprising, in a system where the ink residue is calculated by obtaining ink discharge discharged from an ink container on the basis of the working time of an ink supply pump which sucks ink from the ink container and discharges the same and the ink discharge per unit working time of the ink supply pump and cumulatively subtracting the ink discharge discharged from the ink container from the total ink volume accommodated in the ink container, a temperature detecting means which detects the working environmental temperature of the ink, an ink container which is provided with a storage means which stores a parameter used in the correction based on the kind of the ink and the working environmental temperature of the ink, an ink kind obtaining means which obtains the parameter, and an ink residue calculating means which corrects the ink discharger per unit working time of the ink supply pump on the basis of the parameter, and calculates the ink residue on the basis of the corrected ink discharge.

10. An ink residue calculating system as defined in claim 9 in which the kind of the ink represents the viscosity of the ink.

* * * * *